US010472577B2

(12) United States Patent
Negiz et al.

(10) Patent No.: US 10,472,577 B2
(45) Date of Patent: Nov. 12, 2019

(54) COMPOSITION FOR OPENING POLYCYCLIC RINGS IN HYDROCRACKING

(71) Applicant: UOP LLC, Des Plaines, IL (US)

(72) Inventors: Antoine Negiz, Wilmette, IL (US); Shurong Yang, Naperville, IL (US); Richard R. Willis, Cary, IL (US); Gregory J. Gajda, Mount Prospect, IL (US); Suheil F. Abdo, Lincolnshire, IL (US); Lisa M. Knight, Chicago, IL (US); Hayim Abrevaya, Kenilworth, IL (US); John A. Petri, Wauconda, IL (US)

(73) Assignee: UOP LLC, Des Plaines, IL (US)

( * ) Notice: Subject to any disclaimer, the term of this patent is extended or adjusted under 35 U.S.C. 154(b) by 194 days.

(21) Appl. No.: 15/630,297

(22) Filed: Jun. 22, 2017

(65) Prior Publication Data

US 2018/0371335 A1 Dec. 27, 2018

(51) Int. Cl.
*C10G 45/64* (2006.01)
*C10G 45/62* (2006.01)
(Continued)

(52) U.S. Cl.
CPC ..... *C10G 45/64* (2013.01); *C10G 45/54* (2013.01); *C10G 45/60* (2013.01); *C10G 45/62* (2013.01);
(Continued)

(58) Field of Classification Search
CPC ..... C10G 45/62; C10G 45/64; C10G 45/54
See application file for complete search history.

(56) References Cited

U.S. PATENT DOCUMENTS 4,676,885 A 6/1987 Bush
5,463,155 A 10/1995 Galperin et al.
(Continued)

FOREIGN PATENT DOCUMENTS

CN 1492918 A 4/2004
CN 101254471 B 6/2011
(Continued)

OTHER PUBLICATIONS

Egan, Hydrocracking of N-Butylbenzene, SEC.-Butylbenzene, and Benzene With Palladium on Silica-Alumina Catalysts; J Catal V36 N.3 313-19 (Mar. 1975), v 36, n 3, p. 313-19, Mar. 1975.
(Continued)

*Primary Examiner* — Ellen M McAvoy
(74) *Attorney, Agent, or Firm* — Paschall & Maas Law Office, LLC; James C. Paschall

(57) ABSTRACT

A catalyst composition comprising a support comprising a mixture of amorphous silica-alumina and non-zeolitic alumina comprising no more than 75 wt % amorphous silica-alumina and having a ratio of moles of silicon to moles of aluminum in the range of about 0.05 to about 0.50. A first hydrogenation metal comprising platinum, a second hydrogenation metal from Group VIIB or Group VIII of the Periodic Table other than platinum and an optional third metal from Group IA of the Periodic Table may be deposited on the support. The ratio of moles of silicon to the moles of the first hydrogenation metal, the second hydrogenation metal and the optional third metal on the support may be between about 15 and about 75.

20 Claims, 1 Drawing Sheet

(51) Int. Cl.

| | |
|---|---|
| ***C10G 45/54*** | (2006.01) |
| ***C10G 45/72*** | (2006.01) |
| ***C10G 49/26*** | (2006.01) |
| ***C10G 45/60*** | (2006.01) |
| ***C10G 47/12*** | (2006.01) |
| ***C10G 47/18*** | (2006.01) |
| ***C10G 47/20*** | (2006.01) |

(52) U.S. Cl.
CPC ..... *C10G 45/72* (2013.01); *C10G 47/12* (2013.01); *C10G 47/18* (2013.01); *C10G 47/20* (2013.01); *C10G 49/26* (2013.01)

(56) References Cited

U.S. PATENT DOCUMENTS

| | | | | |
|---|---|---|---|---|
| 5,763,731 | A * | 6/1998 | McVicker | C07C 5/31 208/137 |
| 6,235,962 | B1 * | 5/2001 | Zeuthen | B01J 23/63 585/700 |
| 6,362,123 | B1 | 3/2002 | Tsao et al. | |
| 6,500,329 | B2 | 12/2002 | Tsao et al. | |
| 7,700,514 | B2 * | 4/2010 | Mabilon | B01J 23/42 502/224 |
| 8,658,020 | B2 | 2/2014 | Alvarez et al. | |
| 9,040,449 | B2 | 5/2015 | Semagina et al. | |
| 2002/0063082 | A1 * | 5/2002 | Touvelle | B01J 23/468 208/134 |
| 2006/0063958 | A1 * | 3/2006 | Galperin | B01J 23/40 585/752 |
| 2006/0281957 | A1 * | 12/2006 | Galperin | B01J 35/0006 585/353 |
| 2007/0010682 | A1 | 1/2007 | Myllyoja et al. | |
| 2007/0078289 | A1 * | 4/2007 | Xu | B01J 23/462 585/752 |
| 2007/0144942 | A1 * | 6/2007 | Tiitta | B01J 23/40 208/137 |
| 2008/0190811 | A1 * | 8/2008 | Mao | B01J 21/12 208/110 |
| 2015/0367332 | A1 * | 12/2015 | Kuvettu | B01J 37/06 502/66 |
| 2016/0220987 | A1 * | 8/2016 | Lai | B01J 29/80 |

FOREIGN PATENT DOCUMENTS

| | | | |
|---|---|---|---|
| CN | 101254472 | B | 8/2011 |
| CN | 104357083 | A | 2/2015 |
| CN | 103372459 | B | 4/2015 |
| CN | 103059934 | B | 11/2015 |
| EP | 1920833 | A1 | 5/2008 |
| EP | 2955215 | A1 | 12/2015 |
| FR | 2384839 | A1 | 10/1978 |
| WO | 2007006924 | A1 | 1/2007 |
| WO | 2015189058 | A1 | 12/2015 |

OTHER PUBLICATIONS

Regali et. al. , Hydroconversion of n-hexadecane on Pt/silica-alumina catalysts: Effect of metal loading and support acidity on bifunctional and hydrogenolytic activity, Applied Catalysis A: General, v 469, p. 328-339, 2014.

Shirokopoyas et. al., Hydrogenation of aromatic hydrocarbons in the presence of dibenzothiophene over platinum-palladium catalysts based on Al-SBA-15 aluminosilicates, Petroleum Chemistry, v 54, n 2, p. 94-99, Mar. 2014.

Castano et. al., Effect of the support on the kinetic and deactivation performance of Pt/support catalysts during coupled hydrogenation and ring-opening of pyrolysis gasoline, Applied Catalysis A: General, v 333, n 2, p. 161-171, Dec. 15, 2007.

Hassan et. al., Selective hydrogenation of acetylene in ethylene mixture over Pd/γ-alumina catalyst/the effect of palladium content on activity, CHISA 2012—20th International Congress of Chemical and Process Engineering and Pres 2012—15th Conference Pres, 2012, CHISA 2012—20th International Congress of Chemical and Process Engineering and Pres 2012—15th Conference Pres.

Jiang et. al. , Characterization and application of a Pt/ZSM-5/SSMF catalyst for hydrocracking of paraffin wax, Catalysis Communications, v 60, p. 1-4, Feb. 5, 2015.

Albonetti et. al. , Nanosized Pd/Pt and Pd/Rh catalysts for naphthalene hydrogenation and hydrogenolysis/ring-opening, Catalysis Letters, v 108, n 3/4, p. 197-207, May 2006; ISSN: 1011372X; DOI: 10.1007/s10562-006-0042-x; Publisher: Kluwer Academic Publishers.

Villasenor et. al., A reaction model for the hydroconversion of 2-methylnaphthalene over Pt/mordenite catalysts, 2007 AIChE Annual Meeting, 2007; ISBN-13: 9780816910229; Conference: 2007 AIChE Annual Meeting, Nov. 4, 2007-Nov. 9, 2007; Publisher: American Institute of Chemical Engineers.

Gonzalez et. al., Hydroconversion of 2-methylnaphthalene on Pt/mordenite catalysts. Effect of the acid/metal balance of the catalyst over the main reaction pathways, AIChE Annual Meeting, Conference Proceedings, 2006; ISBN-10: 081691012X, ISBN-13: 9780816910120; Conference: 2006 AIChE Annual Meeting, Nov. 12, 2006-Nov. 17, 2006; Publisher: American Institute of Chemical Engineers.

Rojas et. al., Hydrocracking of aromatics and naphtheno-aromatics, AIChE 2013-2013 AIChE Spring Meeting and 9th Global Congress on Process Safety, Conference Proceedings, 2013, AIChE 2013-2013 AIChE Spring Meeting and 9th Global Congress on Process Safety, Conference Proceedings; ISBN-13: 9780816910755; Conference: 2013 AIChE Spring Meeting and 9th Global Congress on Process Safety, AIChE 2013, Apr. 28, 2013-May 2, 2013; Publisher: American Institute of Chemical Engineers.

Arribas, Hydrogenation and ring opening of mono- and diaromatics for diesel upgrading on Pt/Beta catalysts, Arribas, M.A.1 Email author amart@itq.upv.es; Mahiques, J.J.1; Martinez, A.1, Studies in Surface Science and Catalysis, v 135, p. 303, 2001, Zeolites and Mesoporous Materials at the dawn of the 21st century, Proceedings of the 13 International Zeolite Conference, 2001; ISSN: 01672991; ISBN-13: 9780444502384; DOI: 10.1016/S0167-2991 (01)81678-5; Conference: Zeolites and Mesoporous Materials at the dawn of the 21st century, Proceedings of the 13.

* cited by examiner

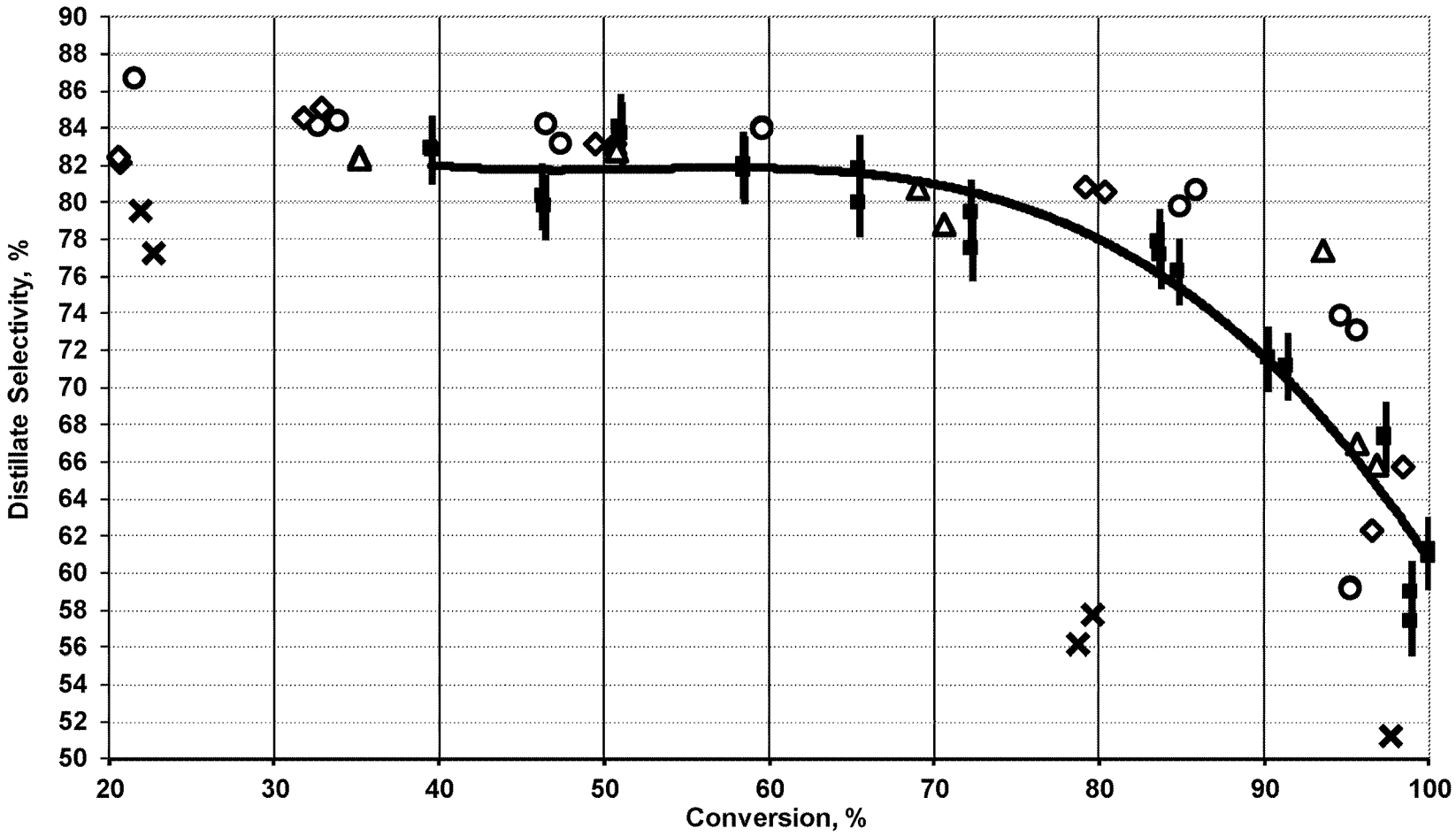
Distillate Selectivity, %
90
88
86
84
82
80
78
76
74
72
70
68
66
64
62
60
58
56
54
52
50
20
30
40
50
60
70
80
90
100
Conversion, %

COMPOSITION FOR OPENING POLYCYCLIC RINGS IN HYDROCRACKING

FIELD

The field is a catalyst for hydrocracking hydrocarbon streams, particularly a catalyst for opening polycyclic rings.

BACKGROUND

Hydroprocessing includes processes which convert hydrocarbons in the presence of hydroprocessing catalyst and hydrogen to more valuable products. Hydrocracking is a hydroprocessing process in which hydrocarbons crack in the presence of hydrogen and hydrocracking catalyst to lower molecular weight hydrocarbons. Depending on the desired output, a hydrocracking reactor may contain one or more fixed beds of the same or different catalyst.

In hydrocracking, feeds contain concentrations of polycyclic aromatic and aliphatic rings which have low cetane value. Polycyclic ring molecules or compounds are organic molecules that are composed of alkylated forms of multiple aromatic or aliphatic rings or combinations thereof. The alkylated multiple rings can be fused such as in a naphthalene or can be alkylated with a degree of branching, or connected to other single or multiple fused rings via one or more alkyl groups. The alkylated polycyclic rings can also include aliphatic rings with either partially saturated single rings or fused rings like alkylated tetralins or fully saturated rings like the alkylated decalins. The smallest polycyclic ring compounds are bicyclic ring compounds which may comprise fused rings or two rings connected by an alkyl group and each of which rings may be aromatic or aliphatic.

It is desirable to open the rings of these polycyclic compounds having more than two rings to reduce them to bicyclic compounds such as naphthalenes and naphthenes and open the rings of the bicyclics to crack them into alkyl naphthenes and paraffins. Ring opening typically requires aromatic rings to be saturated before the ring can be opened. While opening the rings of the bicyclic compounds, it is desirable to preserve all of the original carbon atoms on the original bicyclic molecule rather than truncating the bicyclic molecule to smaller paraffins, aromatics and cycloalkanes. The alkyl naphthenes and paraffins that retain all of the original carbon atoms on the original bicyclic molecule contribute to a higher cetane number in the recovered diesel product stream. The smaller paraffins, aromatics and cycloalkanes end up in the naphtha boiling range thereby diminishing the resulting diesel selectivity.

Two-stage hydrocracking processes involve fractionation of a hydrocracked stream from a first stage hydrocracking reactor followed by hydrocracking of an unconverted oil (UCO) stream in a second stage hydrocracking reactor. However, the best two-stage hydrocracking process cannot achieve full conversion to materials boiling below the diesel cut point. Typically, a bottoms stream from the fractionation column in two-stage hydrocracking unit comprises a UCO stream that is recycled to the second stage hydrocracking reactor for further conversion in a sweet environment. UCO is concentrated with bicyclic aromatic and aliphatic compounds that are desirably cracked into compounds boiling in the diesel range.

Better catalyst compositions are desired to open polycyclic aromatic and aliphatic rings while preserving more of the original carbon atoms on the molecule during hydrocracking.

BRIEF SUMMARY

A catalyst composition may comprise a support comprising a mixture of amorphous silica-alumina and non-zeolitic alumina comprising no more than 75 wt % amorphous silica-alumina and having a ratio of moles of silicon to moles of aluminum in the range of about 0.05 to about 0.50. A first hydrogenation metal comprising platinum, a second hydrogenation metal from Group VIIB or Group VIII of the Periodic Table other than platinum and an optional third metal from Group IA of the Periodic Table may be deposited on the support. The ratio of moles of silicon to the moles of the first hydrogenation metal, the second hydrogenation metal and the optional third metal on the support may be between about 15 and about 55. Alternatively, the ratio of moles of silicon to the moles of the first hydrogenation metal, the second hydrogenation metal and the optional third metal on the support may be between about 55 and about 75 with a ratio of moles of the second hydrogenation metal to the first hydrogenation metal of less than about 1.5. In an embodiment, the ratio of moles of silicon to moles of aluminum may be no more than 0.20.

An alternative catalyst composition may comprise a support comprising a mixture of non-zeolitic alumina and amorphous silica-alumina having more than 20 wt % silica in the amorphous silica-alumina and having an overall ratio of moles of silicon to moles of aluminum in the range of about 0.05 to about 0.20. A first hydrogenation metal comprising platinum and a second hydrogenation metal from Group VIIB or Group VIII of the Periodic Table other than platinum may be deposited on the support.

BRIEF DESCRIPTION OF THE DRAWING

The FIGURE is a graph of distillate selectivity as a function of conversion.

DETAILED DESCRIPTION

The ring-opening catalyst disclosed is observed to be particularly useful in the hydrocracking of vacuum gas oil range molecules to distillate range products with better fuel quality, higher cetane number, higher hydrogen content, and lower density thus providing higher volumetric yields. With polycyclic aromatics and aliphatic rings, hydrocracking is desired to crack the polycyclic compound to a bicyclic compound and to subsequently open at least one ring of the two remaining rings to produce an alkylated single-ring aromatic, a single ring, alkylated aliphatic or a paraffin that retains all of the carbon atoms in the original bicyclic molecule. It is undesirable to hydrocrack the two-ring compound to smaller molecules thereby cleaving molecules into the naphtha boiling range or even into the light gas range. The ring-opening catalyst is particularly useful in the opening of a ring of a bicyclic fused aromatic or aliphatic molecule such as naphthalene, a decalin or a tetralin which may comprise an alkyl group to produce an alkyl-monocyclic aromatic, a monocyclic aliphatic or a paraffin. The ring opening catalyst is advantageous because it can open rings as described without cracking off alkyl groups to produce naphtha or light gas which has a lower cetane value than a ring opened molecule that still contains all of the carbon atoms of the original bicyclic molecule with which it started.

The ring opening catalyst is able to maximize ring opening of naphthalenes at a lower hydrocracking reaction temperature than at which cracking is maximized. The existence of a temperature differential between the maximum hydrocracking ring opening temperature and the maximum hydrocracking cracking temperature allows a hydrocracking reaction zone to open two-ring compounds while avoiding the cracking of the two-ring compounds into less valuable products.

Suitable feeds for the ring opening hydrocracking catalyst will be in the vacuum gas oil range. "Vacuum gas oil" means a hydrocarbon material having an "initial boiling point" (IBP) of at least about 232° C. (450° F.), a T5 between about 288° C. (550° F.) and about 371° C. (700° F.), typically no more than about 343° C. (650° F.), a T95 between about 500° C. (932° F.) and about 570° C. (1058° F.) or an EP of no more than about 626° C. (1158° F.) prepared by vacuum fractionation of atmospheric gas oil as determined by any standard gas chromatographic simulated distillation method such as ASTM D2892, D2887, D6352 or D7169, all of which are used by the petroleum industry. The term "T5", "T35" or "T95" means the temperature at which 5 mass percent, 35 mass percent or 95 mass percent, as the case may be, respectively, of the sample boils using ASTM D2887. The term IBP means the temperature at which the sample begins to boil using ASTM D28887. The term "end point" (EP) means the temperature at which the sample has all boiled off using ASTM D2887. Suitable VGO material may have been previously hydrotreated or hydrocracked with gases such as ammonia and hydrogen sulfide removed or still present in the feed to the hydrocracking reactor. The feed may comprise UCO boiling in the VGO range that has not undergone conversion when subjected to an upstream first stage hydrocracking reactor. The first stage hydrocracking effluent may have been separated, stripped and/or fractionated to provide the UCO stream. The feed can comprise between about 1.5 wt % to about 0.5 wppm sulfur and between about 500 wppm to about 0.2 wppm nitrogen. Hydroprocessed feed such as UCO will be at the lower end of the range; whereas, unhydroprocessed feed will be at the higher end of the range.

As used herein, the term "diesel boiling range" means hydrocarbons boiling in the range of an IBP between about 125° C. (257° F.) and about 175° C. (347° F.) or a T5 between about 150° C. (302° F.) and about 200° C. (392° F.) or no more than a "diesel cut point" between about 343° C. (650° F.) and about 399° C. (750° F.) using the TBP distillation method. The T95 may be between about 343° C. (650° F.) and about 399° C. (750° F.). The term "diesel boiling range" may mean hydrocarbons boiling in the range of between an IBP of about 132° C. (270° F.) and the diesel cut point of about 379° C. using the TBP distillation method. The term "diesel conversion" means conversion of feed that boils above the diesel cut point to material that boils at or below the diesel cut point in the diesel boiling range.

The ring opening catalyst comprises a support comprising a mixture of amorphous silica-alumina and non-zeolitic alumina having an overall mole ratio of silicon to aluminum in the range of about 0.05 to about 0.50, suitably about 0.05 to about 0.20 and preferably about 0.10 to about 0.20. The amorphous silica-alumina (ASA) may comprise a porous amorphous silica-alumina such as a Siral high pore volume ASA, but high pore volume is not needed for the ring opening catalyst to be effective. The ASA may comprise from about 20 to about 50 wt % silica with the balance being alumina. The ASA should have a mole ratio of silicon to aluminum of at least about 0.1 in the support and preferably at least about 0.25. The ASA should have a mole ratio of silicon to aluminum in the support of no more than about 2.0 suitably no more than about 1.8, more suitably no more than about 1.5, preferably no more than about 1.0 and most preferably no more than about 0.6.

The proportion of amorphous silica-alumina in the support should be between about 20 and 75 wt % of the support, suitably no more than 70 wt % and preferably no more than about 60 wt % and most preferably no more than 50 wt %.

The support of the ring opening catalyst should comprise between about 5 and about 25 wt % silica and best results are achieved when the support comprises between about 11 and about 20 wt % silica and preferably no more than about 15 wt % silica in the support.

The ASA powder prior to incorporation into the support may have total pore volume between about 0.5 and about 2.0 cc/g and preferably between about 0.6 and about 1.6 cc/g determined by low temperature $N_2$ adsorption using Micromeritics ASAP 2420 at 77 K. The average pore diameter of the ASA powder prior to incorporation into the support may be between about 40 and about 140 angstroms and preferably be between about 50 and about 130 angstroms determined by the BJH Method. The total BET surface area of the ASA powder prior to incorporation may be between about 400 and about 550 $m^2/g$ and preferably be between about 410 and about 510 $m^2/g$.

Any alpha, eta, theta or gamma alumina would be a suitable alumina for the support, with gamma being preferred. A suitable alumina for the support may be Catapal C. Versal alumina may also be acceptable.

The catalyst may include a refractory binder or matrix other than alumina that is optionally utilized to facilitate fabrication and provide strength. Suitable binders can include inorganic oxides, such as at least one of magnesia, zirconia, chromia, titania, boria, thoria, phosphate, zinc oxide and silica.

The supports are devoid of a zeolitic component, so the support is non-zeolitic. We have found that the zeolitic supports are prone to crack the bicyclic rings to products below the diesel boiling range instead of preserving diesel boiling range products as desired.

The catalyst support may be made by peptizing the ASA with the alumina using an acid such as nitric acid and making it into a dough. The dough may be extruded by known methods. The extrudates may be dried and subsequently calcined for example between about 540-650° C. for 2-3 hours in air.

Two hydrogenation metals may be deposited on the support of the ring opening catalyst. A first hydrogenation metal comprises platinum. The ring opening catalyst may comprise no more than 0.7 wt %, suitably no more than 0.6 wt % and preferably no more than 0.5 wt % platinum.

A second hydrogenation metal comprises a metal from Group VIIB or Group VIII of the Periodic Table other than platinum. The second hydrogenation metal may be palladium, iridium, rhenium, ruthenium or rhodium. Palladium is the preferred second hydrogenation metal. The mole ratio of the second hydrogenation metal to the first hydrogenation metal may be 4 or less in the support and suitably may be 2 or less in the support. In some cases, the mole ratio of the second hydrogenation metal to the first hydrogenation metal may be no more than 1.5 in the support. In an aspect, the first hydrogenation metal is alloyed with the second hydrogenation metal.

An optional third alkali metal selected from Group IA of the Periodic Table may also be deposited on the support. The third alkali metal attenuates the acid in the support to mitigate cracking. The first hydrogenation metal, the second hydrogenation metal and the optional third alkali metal, if present, are deposited on the support. Sodium is a preferred third alkali metal.

An important aspect of the ring opening catalyst is balancing the metal hydrogenation function with the acidic cracking function. We have found that the ratio of the moles of silicon to the sum of moles of metals comprising the first hydrogenation metal, the second hydrogenation metal and the optional third alkali metal, if present, on the support should be between about 10 and about 55, suitably between about 10 and about 50 and preferably between about 17 and about 48 to balance the acid function with the hydrogenation function. The ratio of the moles of silicon to the sum of moles of metals comprising the first hydrogenation metal, the second hydrogenation metal and the optional third alkali metal, if present, on the support may go up to 70 if the ratio of moles of the second hydrogenation metal to the first hydrogenation metal is no more than 1.5.

The metals may be deposited on the support by rotary impregnation of the metal-free support with aqueous solutions of the metal compounds. Chloride salts are suitable but other anions may make suitable impregnating salts. Any salt, including nitrates, sulfates, hydroxides, etc. that can be made soluble in a liquid at a given pH may be used as a metal precursor. Rhenium may be deposited on the support using perrhenic acid, $HReO_4$. Platinum may be deposited on the support using chloroplatinic acid (CPA), $H_2PtCl_6$. Palladium may deposited on the support using palladium (II) chloride. Iridium may be deposited on the support using iridium (III) chloride hydrate. Ruthenium may deposited on the support using trichloronitrosylruthenium ($Cl_3NORu.H_2O$). Rhodium may be deposited on the support using rhodium (III) chloride hydrate ($RhCl_3.H_2O$). Sodium chloride may be used to add sodium to the support.

The metal salt may be deposited on the support by making a solution with the metal salt, made from mixing the desired mass of the metal in the salt that is desired on the catalyst support in water which may include a buffer acid. The support is loaded in the salt solution and subjected to evaporation leaving the metals on the catalyst supports. The final wt-% of the metals in the support is then determined based on the wt-% of the metals in the salt provided in solution. The metals may be impregnated on the supports in successive solutions.

During impregnation it is important that the support have a charge that is opposite to the charge of the metal to be impregnated. The alumina in the support should have a positive charge if the hydrogenation metal is part of or is a negative ion in the precursor metal salt. At a given pH of the impregnation solution all of the metal salt(s) should go into solution. An acid buffer can be added to the solution to bring the pH of the solution down to the point that will give the alumina the appropriate charge to attract the metal ion. The acid buffer can use the same anion as the metal salt. For example, if CPA is the platinum salt, hydrochloric acid can be the buffer acid.

In an aspect, we have found that the first hydrogenation metal and the second hydrogenation metal may be both deposited on the support at the same time in a single impregnation solution. In a further aspect, we have found that the first hydrogenation metal, the second hydrogenation metal and the third alkali metal if used may be both deposited on the support at the same time in a single impregnation solution. On the other hand, iridium may be impregnated by a first impregnating solution of iridium (III) chloride hydrate without an acid buffer, dried and followed by impregnation with a CPA solution using the acid buffer.

The impregnations may be done with a solution: support volume ratio of 0.5 to 2 and preferably between 0.75 and 1.5. The metal-free support may be mixed with the metal salt solution, agitated and heated to evaporate off the liquid. When the impregnated support is dry each catalyst sample may then be calcined in a tray oven at 520 to 560° C. for 2 hours under 25 to 50° C. water saturated air purge. The platinum and ruthenium, rhodium and iridium catalysts may undergo calcination at less severe conditions such as heating for 2 hours up to 260 to 290° C. The metal supported catalysts may be purged with nitrogen at room temperature after calcination and then reduced by streaming hydrogen at 380 to 420° C. over the catalysts for four hours. We have found the first hydrogenation metal and the second hydrogenation metal on the support alloy with each other at least when the second hydrogenation metal is palladium and believe it will occur with all of the second hydrogenation metals.

The ring-opening catalysts may be used in a hydrocarbon conversion process. The hydrocarbon conversion process may be a hydrocracking process. In a hydrocracking process, a hydrocracking feed stream which may comprise VGO. In an aspect, the hydrocracking feed stream may be a cycle oil stream from an FCC unit, such as a light cycle oil stream. The hydrocracking feed stream may have been previously hydrotreated and or hydrocracked. The hydrocracking feed stream may not have been previously hydrotreated or hydrocracked or may have just been previously hydrotreated. Gases such as hydrogen sulfide or ammonia generated by upstream hydrotreating or hydrocracking may be removed from the hydrocracking feed stream. The hydrocracking feed stream may be introduced into a bed of the ring-opening catalyst along with hydrogen and hydrocracked in a hydrocracking reactor to provide a hydrocracked stream. In some aspects, the hydrocracking process may provide total conversion of at least about 20 vol-% and typically greater than about 60 vol-% of the hydrocracking feed to products boiling below the diesel cut point. The hydrocracking reactor may operate at a partial conversion of more than about 50 vol-% or higher conversion of at least about 90 vol-% of the feed based on total conversion. The hydrocracking conditions in the hydrocracking reactor may include a temperature from about 290° C. (550° F.) to about 468° C. (875° F.), preferably 343° C. (650° F.) to about 435° C. (815° F.), a pressure from about 4.8 MPa (700 psig) to about 20.7 MPa (3000 psig), a liquid hourly space velocity (LHSV) from about 0.3 to less than about 2.5 $hr^{-1}$ and a hydrogen rate of about 421 (2,500 scf/bbl) to about 2,527 $Nm^3/m^3$ oil (15,000 scf/bbl). Multiple beds of catalyst may be used and supplemental hydrogen may be added at locations between catalyst beds in the hydrocracking reactor. The ring-opening catalyst is particularly useful in the opening of a ring in a bicyclic ring molecule such as naphthalene, decalin and tetralin to produce an alkyl-single-ring aromatic or aliphatic or a paraffin without cracking off alkyl groups to produce naphtha or light gas.

EXAMPLES

Example 1

Catalysts were made according to the foregoing teachings and tested. The catalyst support was made by peptizing the ASA with the alumina using nitric acid and made into a dough. The dough was extruded, dried and subsequently calcined between about 540-650° C. for 2-3 hours in air. The support was added to a jacketed glass evaporator jar, immediately followed by an aqueous solution of CPA and the second metal salt comprising palladium (II) chloride and in one case the third alkali metal, sodium chloride.

The concentration of metal was provided to achieve the desired weight fraction of the metal in the catalyst in a solution of water and 1 wt % hydrochloric acid having a pH of less than 3. The catalyst support and salt solution were mixed in a 1:1 solution:support volume ratio in an evaporator jar. The support and solution was cold-rolled for an hour in the evaporator jar before steam was introduced to the jacket of the evaporator jar to begin drying. When the impregnated support was dry, the steam was shut off. Each catalyst was then be calcined in a tray oven at 538° C. for 2 hours under room temperature water saturated air purge. The catalysts were then reduced after nitrogen purge by streaming hydrogen at 399° C. over them for four hours. The metals impregnated on the supports were alloyed with each other. The final wt-% of the components in the support were determined based on the wt-% of the components added to solution during formation of the catalysts. Table 1 shows the catalysts and their characteristics.

TABLE 1

| | Support | | | | | | | | | |
|---|---|---|---|---|---|---|---|---|---|---|
| Catalyst | $Al_2O_3$, wt % | ASA, wt % | $SiO_2$ in ASA, wt % | $SiO_2$ all, wt % | Si all, mol % | $Al_2O_3$ in ASA, wt % | $Al_2O_3$ all, wt % | Al all, mol % | ASA Si/Al, mol | Si/Al all, mol |
| 825 | 50 | 50 | 40 | 20 | 0.33 | 60 | 80 | 1.57 | 0.57 | 0.21 |
| 826 | 50 | 50 | 40 | 20 | 0.33 | 60 | 80 | 1.57 | 0.57 | 0.21 |
| 827 | 50 | 50 | 40 | 20 | 0.33 | 60 | 80 | 1.57 | 0.57 | 0.21 |
| 828 | 100 | 0 | 0 | 0 | 0.00 | 0 | 100 | 1.96 | — | 0.00 |
| 829 | 0 | 100 | 75 | 75 | 1.25 | 25 | 25 | 0.49 | 2.55 | 2.55 |
| 830 | 50 | 50 | 23 | 11.5 | 0.19 | 77 | 88.5 | 1.74 | 0.25 | 0.11 |
| 831 | 70 | 30 | 40 | 12 | 0.20 | 60 | 88 | 1.73 | 0.57 | 0.12 |
| 833 | 50 | 50 | 30 | 15 | 0.25 | 70 | 85 | 1.67 | 0.36 | 0.15 |
| 834 | 20 | 80 | 20 | 16 | 0.27 | 80 | 84 | 1.65 | 0.21 | 0.16 |

| Catalyst | Zeolite Type | Zeolite, wt % |
|---|---|---|
| 832 | Y | 10 |
| 835 | Y | 4 |
| 836 | Beta and Y | 4.1 |

| | Metals | | | | | Silicon/ |
|---|---|---|---|---|---|---|
| Catalyst | Pt, wt % | Pd, wt % | Na, wt % | Metal mol % | Pd/Pt, mol | metal, mol |
| 825 | 0.22 | 0.48 | | 0.006 | 3.9 | 59.1 |
| 826 | 0.22 | 0.48 | 0.3 | 0.019 | 3.9 | 17.8 |
| 827 | 0.48 | 0.48 | | 0.007 | 1.8 | 47.8 |
| 828 | 0.48 | 0.48 | | 0.007 | 1.8 | 0.0 |
| 829 | 0.22 | 0.48 | | 0.006 | 3.9 | 221.6 |
| 830 | 0.22 | 0.48 | | 0.006 | 3.9 | 34.0 |
| 831 | 0.22 | 0.48 | | 0.006 | 3.9 | 35.5 |
| 832 | 0.48 | 0.48 | | 0.007 | 1.8 | 78.9 |
| 833 | 0.22 | 0.48 | | 0.006 | 3.9 | 44.3 |
| 834 | 0.22 | 0.48 | | 0.006 | 3.9 | 47.3 |
| 835 | 0.22 | 0.48 | | 0.006 | 3.9 | 109.7 |
| 836 | 0.22 | 0.48 | | 0.006 | 1.8 | 144.8 |

Catalysts 828 and 829 did not have extruded supports but were included to represent 100% alumina and 100% ASA, respectively. The ASA used in Catalyst 830 had about half the total pore volume of the Siral 40 HPV.

A first model feed comprising 25 wt % 1-methylnaphtalene, a two-ring aromatic, 1 wt % normal-C15, 1 wt % normal-C24 and 73 wt % normal octane, 2000 wppm sulfur and 55 wppm nitrogen was fed to a reactor containing 25 $cm^3$ catalyst at hydrocracking conditions. Hydrocracking conditions included a block temperature of 200-360° C., a pressure of 10.4 MPa (g) (2000 psig), 1348 $Nm^3/m^3$ (8000 SCF/B) and an LHSV of 0.75 $hr^{-1}$. The temperature was varied in the reactor to achieve 100% conversion of 1-methylnaphthalene. Results are shown in Table 2.

TABLE 2

| | Selectivity at 100% 1-Methyl Naphthalene | | | | Reaction Temperature, ° C. | | |
|---|---|---|---|---|---|---|---|
| | Conversion, % | | | | Max Ring | Max | |
| Catalyst | Methyl Decalin | C11-1-Ring Naphthenes | C11-Paraffins | C11 Aromatics | Opening Activity | Cracking Activity | Difference |
| 825 | 35 | 38 | 4 | 1 | 415 | 415 | 0 |
| 826 | 52 | 35 | 2 | 1 | 413 | 430 | 17 |
| 827 | 52 | 35 | 2 | 1 | 402 | 418 | 16 |
| 828 | 50 | 22 | 1 | 18 | 476 | 476 | 0 |
| 829 | 47 | 42 | 3 | 0 | 382 | 382 | 0 |

TABLE 2-continued

| | Selectivity at 100% 1-Methyl Naphthalene Conversion, % | | | | Reaction Temperature, ° C. | | |
|---|---|---|---|---|---|---|---|
| Catalyst | Methyl Decalin | C11-1-Ring Naphthenes | C11-Paraffins | C11 Aromatics | Max Ring Opening Activity | Max Cracking Activity | Difference |
| 830 | 35 | 44 | 4 | 0 | 400 | 420 | 20 |
| 831 | 46 | 48 | 4 | 0 | 403 | 420 | 17 |
| 832 | 50 | 30 | 3 | 1 | 263 | 263 | 0 |
| 833 | 56 | 40 | 3 | 0 | 387 | 400 | 13 |
| 834 | 39 | 44 | 4 | 0 | 400 | 400 | 0 |
| 835 | 43 | 38 | 3 | 0 | 369 | 369 | 0 |
| 836 | 49 | 40 | 3 | 0 | 362 | 362 | 0 |

According to Table 2, catalysts with no zeolite and silicon to metal mole ratio between 17 and 48 and less than 75 wt % ASA or more than 20 wt % silica in the ASA were more efficient for ring opening. These catalysts have a temperature differential between the maximum ring opening temperature and the maximum cracking temperature that allows the ring opening to maximize at a temperature below and distinct from the temperature at which cracking maximizes. Catalyst 828 with no ASA exhibited the lowest ring opening activity. Zeolitic catalysts were active for cracking but not selective to ring opening. Catalyst 834 with high ASA but low silica did not provide ring opening selectivity. Catalysts with ASA with less than 40 wt % silica were more efficient for ring opening. Catalysts with ASA of 40 wt % silica required a higher level of platinum or introduction of sodium into their support to provide a ring opening effective catalyst. Alkali metal, sodium, appeared to decrease cracking while maintaining ring opening activity. Additional platinum may have increased ring opening activity while not increasing cracking.

Table 3 further shows the results processed to highlight total conversion of bicyclic aromatic ring compounds, which is in this case, methyl naphthalene, a fused bicyclic aromatic ring compound. Total 2-ring conversion accounts for 2-ring opening products that are not methyl decalin, which does not have any opened rings, Selectivities given are intended to highlight ring opened compounds that increase the cetane value; i.e., C11-1-ring naphthenes and C-11-paraffins and their combined total.

The catalysts with a temperature difference between maximum ring opening activity and maximum cracking activity also offered higher conversion of bicyclic fused aromatic ring compounds and high selectivity to ring opened compounds that increase cetane value. Catalysts 831 and 833 exhibited very high selectivity to C11-1-ring naphthenes and C11-paraffins which have high cetane value.

Example 2

Catalyst 831 of Example 1 was contacted with a second model feed containing less than 0.5 wppm sulfur, less than 0.2 wppm nitrogen, 22 wt % methyltetralins, 5 wt % methyl decalins, 1.3 wt % n-C15, 0.8 wt % n-C-24 and 71.1 wt % n-C7. The model feed had been passed over a molecular sieve and hydrotreated over a hydrotreating catalyst at 10.4 MPa (g) (2000 psig), 674 $Nm^3/m^3$ (4000 SCF/B), 1.5 $hr^{-1}$ LHSV and about 250° C. average bed temperature to remove sulfur and nitrogen contaminants. The second model feed was fed to a reactor containing 25 $cm^3$ catalyst at hydrocracking conditions. Hydrocracking conditions included a temperature of 200-360° C., a pressure of 10.4 MPa (g) (2000 psig), 1348 $Nm^3/m^3$ (8000 SCF/B) and an LHSV of 0.75 $hr^{-1}$. The temperature was varied in the reactor to achieve 100% conversion of 1-methylnaphthalene. Table 4 compares Catalyst 831 performance over both model feeds.

TABLE 3

| | | Selectivity to High Cetane Products, % | | | Reaction Temperature, ° C. | | |
|---|---|---|---|---|---|---|---|
| Catalyst | Total 2-ring Conversion, % | C11-1-Ring Naphthenes | C11-Paraffins | Total Ring Opening | Max Ring Opening Activity | Max Cracking Activity | Difference |
| 825 | 65 | 59 | 6 | 65 | 415 | 415 | 0 |
| 826 | 48 | 72 | 4 | 77 | 413 | 430 | 17 |
| 827 | 48 | 72 | 5 | 77 | 402 | 418 | 16 |
| 828 | 50 | 44 | 2 | 47 | 476 | 476 | 0 |
| 829 | 53 | 79 | 6 | 84 | 382 | 382 | 0 |
| 830 | 65 | 67 | 7 | 74 | 400 | 420 | 20 |
| 831 | 54 | 89 | 7 | 96 | 403 | 420 | 17 |
| 832 | 50 | 60 | 5 | 65 | 263 | 263 | 0 |
| 833 | 44 | 91 | 7 | 97 | 387 | 400 | 13 |
| 834 | 61 | 72 | 6 | 78 | 400 | 400 | 0 |
| 835 | 57 | 67 | 6 | 72 | 369 | 369 | 0 |
| 836 | 51 | 78 | 6 | 84 | 362 | 362 | 0 |

TABLE 4

| Catalyst | Model Feed | Total 2-ring Conversion, % | Selectivity to High Cetane Products, % | | | Reaction Temperature, ° C. | | |
|---|---|---|---|---|---|---|---|---|
| | | | C11-1-Ring Naphthenes | C11-Paraffins | Total Ring Opening | Max Ring Opening Activity | Max Cracking Activity | Difference |
| 831 | 1 | 54 | 89 | 7 | 96 | 403 | 420 | 17 |
| 831 | 2 | 57 | 77 | 7 | 83 | 350 | 365 | 15 |

Table 4 shows that sulfur and nitrogen in the feed raise the temperature required for the predetermined level of ring opening activity by at least 50° C. compared to the clean second model feed by requiring higher reaction temperature to be an effective ring opening catalyst. However, having sulfur and nitrogen in the feed improves the total ring opening selectivity significantly. Accordingly, the ring opening catalyst can be used in environments with or without these contaminants present.

Example 3

Investigation of the impact of alternative noble metals in place of palladium, namely, iridium, rhenium, ruthenium and rhodium was carried out. Catalysts with different second hydrogenation metals were made according to the foregoing teachings and tested. The catalyst support was prepared as taught in Example 1. The aqueous solutions comprised CPA and the second metal salt comprising palladium (II) chloride, perrhenic acid, iridium (III) chloride hydrate and trichloronitrosylruthenium, rhodium (III) chloride hydrate. The catalyst supports were impregnated with a single salt solution except for iridium which was impregnated in two separate solutions. The first solution of iridium (III) chloride hydrate was added to the support omitting the acid buffer followed by drying and impregnating the support in the CPA solution. The platinum and iridium, rhodium and ruthenium catalysts were heated to and calcined for 2 hours at 282° C. The reduction step was performed as for the palladium catalysts of Example 1. The final content of the components in the support were predetermined based on the quantities added during formation of the catalysts. Table 5 lists the catalysts and their characteristics.

TABLE 5

| Catalyst | Support | | | | | | | | | | |
|---|---|---|---|---|---|---|---|---|---|---|---|
| | $Al_2O_3$, wt % | ASA, wt % | Zeolite, wt % | $SiO_2$ in ASA, wt % | $SiO_2$ all, wt % | Si all, mol % | $Al_2O_3$ in ASA, wt % | $Al_2O_3$ all, wt % | Al all, mol % | ASA Si/Al, mol | Si/Al all, mol |
| 839 | 50 | 50 | 0 | 40 | 20 | 0.33 | 60 | 80.00 | 1.57 | 0.57 | 0.21 |
| 840 | 50 | 50 | 0 | 40 | 20 | 0.33 | 60 | 80.00 | 1.57 | 0.57 | 0.21 |
| 841 | 50 | 50 | 0 | 40 | 20 | 0.33 | 60 | 80 | 1.57 | 0.57 | 0.21 |
| 842 | 50 | 50 | 0 | 40 | 20 | 0.33 | 60 | 80 | 1.57 | 0.57 | 0.21 |
| 843 | 50 | 50 | 0 | 40 | 20 | 0.33 | 60 | 80.00 | 1.57 | 0.57 | 0.21 |
| 883 | 70 | 30 | 0 | 40 | 12 | 0.20 | 60 | 88.00 | 1.73 | 0.57 | 0.12 |
| 886 | 70 | 30 | 0 | 40 | 12 | 0.20 | 60 | 88.00 | 1.73 | 0.57 | 0.12 |
| 887 | 70 | 30 | 0 | 40 | 12 | 0.20 | 60 | 88.00 | 1.73 | 0.57 | 0.12 |

| Catalyst | Metals | | | | | |
|---|---|---|---|---|---|---|
| | Pt, wt % | 2d Metal, wt % | 2d Metal | Metal, mol, % | 2d Metal/Pt, mol | Silicon/metal, mol |
| 839 | 0.48 | 0.48 | Ir | 0.005 | 1.0 | 67.2 |
| 840 | 0.75 | 0.48 | Pd | 0.008 | 1.2 | 39.9 |
| 841 | 0.48 | 1.44 | Re | 0.01 | 3.1 | 32.7 |
| 842 | 0.48 | 0.26 | Rh | 0.005 | 1.0 | 66.8 |
| 843 | 0.48 | 0.27 | Ru | 0.005 | 1.1 | 65.0 |
| 883 | 0.48 | 0.48 | Ir | 0.005 | 1.0 | 40.3 |
| 886 | 0.48 | 0.48 | Ir | 0.005 | 1.0 | 40.3 |
| 887 | 0.48 | 0.48 | Pd | 0.007 | 1.8 | 28.7 |

The catalysts of Table 5 were contacted with the second model feed of Example 2 because these noble metals are very sensitive to sulfur and nitrogen. Results are shown in Table 6.

TABLE 6

| Catalyst | | Total 2-ring | Selectivity, % | | | Reaction Temperature, ° C. | | |
|---|---|---|---|---|---|---|---|---|
| No. | 2d Metal | Conversion, % | C11-1-Ring Naphthenes | C11-Paraffins | Total Ring Opening | Max Ring Opening Activity | Max Cracking Activity | Difference |
| 839 | Ir | 67 | 63 | 7 | 70 | 350 | 350 | 0 |
| 840 | Pd | 71 | 59 | 7 | 65 | 352 | 350 | −2 |
| 841 | Re | 68 | 65 | 7 | 72 | 347 | 350 | 3 |
| 842 | Rh | 62 | 73 | 7 | 80 | 346 | 362 | 16 |
| 843 | Ru | 58 | 75 | 7 | 82 | 346 | 362 | 16 |

Rhodium and ruthenium with 1:1 mole ratio with platinum exhibit significantly improved performance. Iridium as the second hydrogenation metal exhibited improved selectivity. Rhenium as the second hydrogenation metal showed some cracking activity. Reducing the concentration of rhenium may serve to reduce cracking activity.

Example 4

Investigation was made into the performance of the ring opening catalysts with a UCO feed. Table 7 shows the catalysts and their characteristics.

TABLE 7

| | Support | | | | | | | | | |
|---|---|---|---|---|---|---|---|---|---|---|
| Catalyst | $Al_2O_3$, wt % | ASA, wt % | $SiO_2$ in ASA, wt % | $SiO_2$ all, wt % | Si all, mol % | $Al_2O_3$ in ASA, wt % | $Al_2O_3$ all, wt % | Al all, mol % | ASA Si/Al, mol | Si/Al all, mol |
| 825-874 | 50 | 50 | 40 | 20 | 0.33 | 60 | 80 | 1.57 | 0.57 | 0.21 |
| 825-875 | 50 | 50 | 40 | 20 | 0.33 | 60 | 80 | 1.57 | 0.57 | 0.21 |
| 825-876 | 50 | 50 | 40 | 20 | 0.33 | 60 | 80 | 1.57 | 0.57 | 0.21 |
| 883 | 70 | 30 | 40 | 12 | 0.20 | 60 | 88 | 1.73 | 0.57 | 0.12 |
| 886 | 70 | 30 | 40 | 12 | 0.20 | 60 | 88 | 1.73 | 0.57 | 0.12 |
| 887 | 70 | 30 | 40 | 12 | 0.20 | 60 | 88 | 1.73 | 0.57 | 0.12 |

| Catalyst | Zeolite Type | Zeolite, wt % |
|---|---|---|
| 881 | Y | 4 |

| Catalyst | | Metals | | | | | |
|---|---|---|---|---|---|---|---|
| No. | Symbol in FIGURE | Pt, wt % | 2d Metal, wt % | 2d Metal | 2d Metal, mol % | 2d Metal/Pt, mol | Silicon/metal, mol |
| 825-874 | ■ | 0.22 | 0.48 | Pd | 0.006 | 3.9 | 59.1 |
| 825-875 | ■ | 0.22 | 0.48 | Pd | 0.006 | 3.9 | 59.1 |
| 825-876 | ■ | 0.22 | 0.48 | Pd | 0.006 | 3.9 | 59.1 |
| 881 | X | 0.22 | 0.48 | Pd | 0.006 | 3.9 | 58.5 |
| 883 | ○ | 0.48 | 0.48 | Ir | 0.005 | 1.0 | 40.3 |
| 886 | ◇ | 0.48 | 0.48 | Ir | 0.005 | 1.0 | 40.3 |
| 887 | Δ | 0.48 | 0.48 | Pd | 0.007 | 1.8 | 28.7 |

The catalysts above were tested with a modified UCO feed comprising 85 wt % UCO having the characteristics given in Table 8 below and modified by adding 5 wt % n-C24, 5 wt % n-C15 and 5 wt % hydrotreated 1-methylnaphthalenes. The UCO feed was fractionated by vacuum distillation apparatus and methods described in ASTM D2892. Boiling ranges in Table 8 were determined using ASTM D2887.

TABLE 8

| Boiling Range | Temperature, ° C. |
|---|---|
| Initial Boiling Point | 383 |
| T5 | 401 |
| T35 | 430 |
| T95 | 509 |

Twenty-five cubic centimeters of catalysts were contacted with the UCO feed at hydrocracking conditions of a block temperature of 230-360° C., a pressure of 10.4 MPa (g) (2000 psig), 1348 $Nm^3/m^3$ (8000 SCF/B) and an LHSV of 0.75 $hr^{-1}$. Results are shown in the FIGURE which exhibits the distillate selectivity as a function of conversion. The symbols for the data points in the FIGURE are given in Table 8. Conversion is defined as percentage of UCO feed components that boiled above 379° C. that was converted to products boiling below 379° C. Distillate selectivity was calculated for products boiling in the range of 132 to 379° C.

In the FIGURE, the vertical bars indicate the confidence region for the 825 catalysts. The solid curve is the best fit to the performance data. The zeolitic catalyst 881 exhibited poor distillate selectivity. The improved ring opening catalysts 883, 886 and 887 also exhibited significantly improved selectivity to distillate for UCO components converted from boiling above 379° C. to products boiling below 379° C. Increase in selectivity is greater than 2% at both medium and high conversion per pass levels.

Example 5

Chemical analysis was performed on metal clusters viewed on spent Catalyst 831 using a scanning transmission electron microscope. The results are presented in Table 9. Catalyst 831 had 3.9 moles of palladium per mole of platinum. Theoretically, the atomic ratio of Pt/(Pt+Pd) should be 20% if all palladium were metallurgically bonded or alloyed to platinum. If no palladium was alloyed with the platinum, the atomic ratio would be 100%.

TABLE 9

| $\frac{Pt}{Pt + Pd}$ | Average | Standard Deviation | Standard Error |
|---|---|---|---|
| Alumina | 41.6 | 13.6 | 1.87 |
| ASA | 40.0 | 16.6 | 2.11 |

The average platinum concentration at around 40% is slightly above the nominal 20% but far from 100%, indicating that platinum is alloying with palladium on the catalyst.

Specific Embodiments

While the following is described in conjunction with specific embodiments, it will be understood that this description is intended to illustrate and not limit the scope of the preceding description and the appended claims.

A first embodiment of the invention is a composition comprising a support comprising a mixture of amorphous silica-alumina and non-zeolitic alumina comprising no more than 75 wt % amorphous silica-alumina and having a ratio of moles of silicon to moles of aluminum in the range of about 0.05 to about 0.50; a first hydrogenation metal comprising platinum; a second hydrogenation metal from Group VIIB or Group VIII of the Periodic Table other than platinum; an optional third metal from Group IA of the Periodic Table; wherein the first hydrogenation metal, the second hydrogenation metal and the optional third metal are deposited on the support; and the ratio of moles of silicon to the moles of the first hydrogenation metal, the second hydrogenation metal and the optional third metal on the support is between about 15 and about 55 or between about 55 and about 75 with a ratio of moles of the second hydrogenation metal to the first hydrogenation metal of less than 1.5. An embodiment of the invention is one, any or all of prior embodiments in this paragraph up through the first embodiment in this paragraph wherein the overall mole ratio of silicon to aluminum in the support is no more than 0.20. An embodiment of the invention is one, any or all of prior embodiments in this paragraph up through the first embodiment in this paragraph wherein the amorphous silica-alumina has a mole ratio of silicon to aluminum of about 0.1 to about 1.0 in the support. An embodiment of the invention is one, any or all of prior embodiments in this paragraph up through the first embodiment in this paragraph wherein the mole ratio of the second hydrogenation metal to the first hydrogenation metal is 4 or less. An embodiment of the invention is one, any or all of prior embodiments in this paragraph up through the first embodiment in this paragraph wherein the mole ratio of the second hydrogenation metal to the first hydrogenation metal is 2 or less. An embodiment of the invention is one, any or all of prior embodiments in this paragraph up through the first embodiment in this paragraph wherein the first hydrogenation metal is alloyed with the second hydrogenation metal. An embodiment of the invention is one, any or all of prior embodiments in this paragraph up through the first embodiment in this paragraph comprising between about 5 and about 25 wt % silica in the support. An embodiment of the invention is one, any or all of prior embodiments in this paragraph up through the first embodiment in this paragraph comprising between about 11 and about 20 wt % silica in the support.

A second embodiment of the invention is a composition comprising a support comprising a mixture of non-zeolitic alumina and amorphous silica-alumina having more than 20 wt % silica in the amorphous silica-alumina and having an overall ratio of moles of silicon to moles of aluminum in the range of about 0.05 to about 0.20; a first hydrogenation metal comprising platinum; a second hydrogenation metal from Group VIIB or Group VIII of the Periodic Table other than platinum; wherein the first hydrogenation metal and the second hydrogenation metal are deposited on the support. An embodiment of the invention is one, any or all of prior embodiments in this paragraph up through the second embodiment in this paragraph wherein the amorphous silica-alumina has a mole ratio of silicon to aluminum of about 0.1 to about 1.0 in the support. An embodiment of the invention is one, any or all of prior embodiments in this paragraph up through the second embodiment in this paragraph wherein the mole ratio of the second hydrogenation metal to the first hydrogenation metal is 4 or less. An embodiment of the invention is one, any or all of prior embodiments in this paragraph up through the second embodiment in this paragraph wherein the mole ratio of the second hydrogenation metal to the first hydrogenation metal is 2 or less. An embodiment of the invention is one, any or all of prior embodiments in this paragraph up through the second embodiment in this paragraph wherein the first hydrogenation metal is alloyed with the second hydrogenation metal. An embodiment of the invention is one, any or all of prior embodiments in this paragraph up through the second embodiment in this paragraph comprising between about 5 and about 20 wt % silica in the support. An embodiment of the invention is one, any or all of prior embodiments in this paragraph up through the second embodiment in this paragraph comprising between about 11 and about 16 wt % silica in the support.

A third embodiment of the invention is a composition comprising a support comprising a mixture of amorphous silica-alumina and non-zeolitic alumina comprising no more than 75 wt % amorphous silica-alumina and having a ratio of moles of silicon to moles of aluminum in the range of about 0.05 to about 0.50; a first hydrogenation metal comprising platinum; a second hydrogenation metal from Group VIIB or Group VIII of the Periodic Table other than platinum; an optional third metal from Group IA of the Periodic Table; wherein the first hydrogenation metal, the second hydrogenation metal and the optional third metal are deposited on the support; and the ratio of moles of silicon to the moles of the first hydrogenation metal, the second hydrogenation metal and the optional third metal on the support is between about 15 and about 55. An embodiment of the invention is one, any or all of prior embodiments in this paragraph up through the third embodiment in this paragraph wherein the overall mole ratio of silicon to aluminum in the support is no more than 0.20. An embodiment of the invention is one, any or all of prior embodiments in this paragraph up through the third embodiment in this paragraph wherein the amorphous silica-alumina has a mole ratio of silicon to aluminum of about 0.1 to about 1.0 in the support. An embodiment of the invention is one, any or all of prior embodiments in this paragraph up through the third embodiment in this paragraph wherein the mole ratio of the second hydrogenation metal to the first hydrogenation metal is 1.5 or less. An embodiment of the invention is one, any or all of prior embodiments in this paragraph up through the third embodiment in this paragraph comprising between about 11 and about 20 wt % silica in the support.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A catalyst composition comprising:

a support comprising a mixture of amorphous silica-alumina and non-zeolitic alumina comprising no more than 75 wt % amorphous silica-alumina and having a ratio of moles of silicon to moles of aluminum in the range of about 0.05 to about 0.50;

a first hydrogenation metal comprising platinum;

a second hydrogenation metal from Group VIIB or Group VIII of the Periodic Table other than platinum;

an optional third metal from Group IA of the Periodic Table;

wherein the first hydrogenation metal, the second hydrogenation metal and the optional third metal are deposited on the support; and the ratio of moles of silicon to the moles of the first hydrogenation metal, the second hydrogenation metal and the optional third metal on the support is between about 15 and about 55 or between about 55 and about 75 with a ratio of moles of the second hydrogenation metal to the first hydrogenation metal of less than 1.5.

2. The composition of claim 1 wherein the overall mole ratio of silicon to aluminum in the support is no more than 0.20.

3. The composition of claim 1 wherein the amorphous silica-alumina has a mole ratio of silicon to aluminum of about 0.1 to about 1.0 in the support.

4. The composition of claim 1 wherein the mole ratio of the second hydrogenation metal to the first hydrogenation metal is 4 or less.

5. The composition of claim 3 wherein the mole ratio of the second hydrogenation metal to the first hydrogenation metal is 2 or less.

6. The composition of claim 1 wherein said first hydrogenation metal is alloyed with the second hydrogenation metal.

7. The composition of claim 1 comprising between about 5 and about 25 wt % silica in the support.

8. The composition of claim 1 comprising between about 11 and about 20 wt % silica in the support.

9. A catalyst composition comprising:

a support comprising a mixture of non-zeolitic alumina and amorphous silica-alumina having more than 20 wt % silica in the amorphous silica-alumina and having an overall ratio of moles of silicon to moles of aluminum in the range of about 0.05 to about 0.20;

a first hydrogenation metal comprising platinum; and a second hydrogenation metal from Group VIIB or Group VIII of the Periodic Table other than platinum; wherein the first hydrogenation metal and the second hydrogenation metal are deposited on the support.

10. The composition of claim 9 wherein the amorphous silica-alumina has a mole ratio of silicon to aluminum of about 0.1 to about 1.0 in the support.

11. The composition of claim 9 wherein the mole ratio of the second hydrogenation metal to the first hydrogenation metal is 4 or less.

12. The composition of claim 11 wherein the mole ratio of the second hydrogenation metal to the first hydrogenation metal is 2 or less.

13. The composition of claim 9 wherein said first hydrogenation metal is alloyed with the second hydrogenation metal.

14. The composition of claim 9 comprising between about 5 and about 20 wt % silica in the support.

15. The composition of claim 9 comprising between about 11 and about 16 wt % silica in the support.

16. A catalyst composition comprising:

a support comprising a mixture of amorphous silica-alumina and non-zeolitic alumina comprising no more than 75 wt % amorphous silica-alumina and having a ratio of moles of silicon to moles of aluminum in the range of about 0.05 to about 0.50;

a first hydrogenation metal comprising platinum;

a second hydrogenation metal from Group VIIB or Group VIII of the Periodic Table other than platinum;

an optional third metal from Group IA of the Periodic Table;

wherein the first hydrogenation metal, the second hydrogenation metal and the optional third metal are deposited on the support; and the ratio of moles of silicon to the moles of the first hydrogenation metal, the second hydrogenation metal and the optional third metal on the support is between about 15 and about 55.

17. The composition of claim 16 wherein the overall mole ratio of silicon to aluminum in the support is no more than 0.20.

18. The composition comprising all the elements of claim 16 wherein the amorphous silica-alumina has a mole ratio of silicon to aluminum of about 0.1 to about 1.0 in the support.

19. The composition of claim 18 wherein the mole ratio of the second hydrogenation metal to the first hydrogenation metal is 1.5 or less.

20. The composition of claim 16 comprising between about 11 and about 20 wt % silica in the support.

* * * * *